US007021743B2

(12) United States Patent
Flotats et al.

(10) Patent No.: US 7,021,743 B2
(45) Date of Patent: Apr. 4, 2006

(54) PRINTHEAD SERVICE STATION

(75) Inventors: Carles Flotats, Barcelona (ES); Antonio Monclus, Barcelona (ES); Gonzalo Gaston, Barcelona (ES); Isabel Borrell, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 217 days.

(21) Appl. No.: 10/687,842

(22) Filed: Oct. 20, 2003

(65) Prior Publication Data

US 2004/0130591 A1 Jul. 8, 2004

(30) Foreign Application Priority Data

Oct. 22, 2002 (GB) ..... 0224478

(51) Int. Cl.
*B41J 2/165* (2006.01)

(52) U.S. Cl. ..... 347/32; 347/29; 347/30; 347/33

(58) Field of Classification Search ..... 347/22, 347/24, 28, 29, 30, 32, 33, 35, 43, 49; 213/75 R, 213/88, 100 R, 152, 211; 105/3, 4.1; 104/173.1, 104/173.2; 400/171, 82
See application file for complete search history.

(56) References Cited

U.S. PATENT DOCUMENTS

| | | | | |
|---|---|---|---|---|
| 2,273,621 | A * | 2/1942 | Piron | 213/75 R |
| 5,018,884 | A * | 5/1991 | Hirano et al. | 347/30 |
| 5,587,729 | A | 12/1996 | Lee et al. | |
| 5,644,345 | A * | 7/1997 | Toniolo | 347/32 |
| 5,984,450 | A * | 11/1999 | Becker et al. | 347/24 |
| 5,997,126 | A | 12/1999 | Nguyen et al. | |
| 6,135,585 | A * | 10/2000 | Johnson et al. | 347/32 |
| 6,193,353 | B1 * | 2/2001 | Vives et al. | 347/29 |
| 6,644,775 | B1 * | 11/2003 | Murcia et al. | 347/24 |

FOREIGN PATENT DOCUMENTS

| | | |
|---|---|---|
| EP | 0 676 287 | 5/1998 |
| EP | 0 673 772 | 9/1998 |

* cited by examiner

*Primary Examiner*—Shih-Wen Hsieh
(74) *Attorney, Agent, or Firm*—Foley & Lardner LLP

(57) ABSTRACT

The printheads of an inkjet printer have a service station movable in a direction transversely of a printhead scanning direction and comprising servicing modules for undertaking different functions, one of the modules being detachable from the rest. The detachable connection comprises a rotating hook and a fixed hook which automatically interengage and disengage.

13 Claims, 3 Drawing Sheets

PRINTHEAD SERVICE STATION

The present invention relates to the servicing of printheads in hardcopy apparatus, in which the printheads or pens are subjected to one or more servicing operations in a service station. The servicing operations may include wiping, spitting, the application of a cleaning and/or lubricating liquid and capping the pens.

As the number of types of required servicing operations increases, and with the servicing modules for each operation arranged successively along the printhead scanning direction, this dimension of the service station, and hence of the hardcopy apparatus, also grows.

To reduce this problem, EP-A-0,673,772 proposes arranging the individual servicing modules transversely of the printhead scanning direction, i.e. in the direction of the paper axis, and providing a drive arrangement for bringing the desired servicing module into alignment with the printheads. U.S. Pat. No. 5,587,729 and EP-A-0,728,585 also disclose servicing modules moveable transversely of the printhead scanning direction. However, in these devices too, an increasing number of types of servicing operations can also lead to space problems. In addition, even modules for relatively rarely used servicing operations are moved each time the servicing station motor operates, thus imposing higher loads on the motor, reducing its speed and shortening its lifetime.

Certain aspects of the present invention seek to overcome or reduce one or more of the above disadvantages.

According to a first aspect of the present invention, there is provided a hardcopy device comprising one or more printheads, which is/are arranged to move in a scanning direction along a scanning axis, a printhead service station arranged at an end of said printhead scanning axis and comprising a movable service station carriage having a plurality of servicing modules arranged to undertake servicing operations on the or each printhead, and means for moving the service station carriage transversely of said scanning axis, wherein at least one of the servicing modules is detachably connected to the other servicing module(s).

According to a second aspect of the present invention, there is provided a service station for a hardcopy device comprising a plurality of servicing modules, at least one of the modules being detachably connected to the other servicing modules.

According to a third aspect of the present invention, there is provided a method of servicing printheads of hardcopy devices comprising moving the printheads in the printhead scanning direction into a servicing position, and, for at least a first servicing operation, moving a service station transversely of the scanning direction to bring a first servicing module into alignment with the printheads to undertake the first servicing operation, and, for at least a second servicing operation, moving the service station to a position in which it is attached to an optional servicing module and then to a position in which at least the optional servicing module is in alignment with the printheads to undertake the second servicing operation.

As used herein the expression hardcopy device covers all types of printers in addition to facsimile machines, scanners and photocopiers.

In hardcopy devices in which the printheads are mounted on a movable carriage, the scanning axis is defined as the direction along which the carriage moves.

A service station is a component part of a hardcopy device which is typically located at one end of the scanning axis and undertakes one or more operations on the printheads.

Usually a service station undertakes a plurality of different operations on the printheads. Each operation is undertaken by a respective part of the service station known as a servicing module. Thus a service station comprises a plurality of servicing modules.

Preferred embodiments of the present invention will now be described, by way of example only, with reference to the accompanying drawings, of which:

Figure 7A:
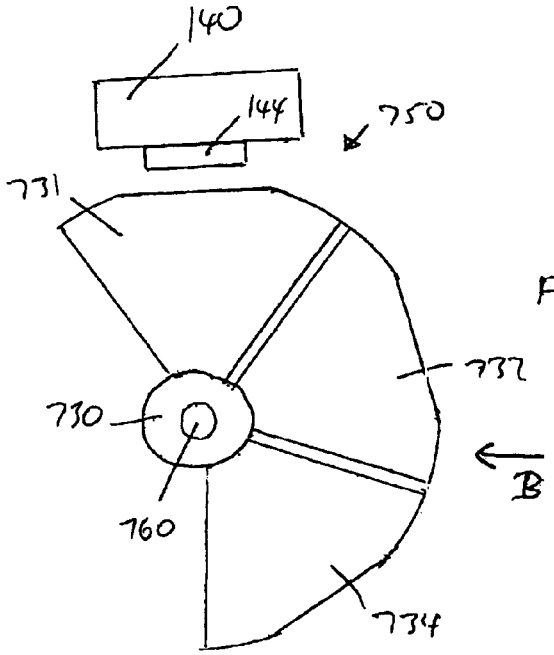
Figure 7B:
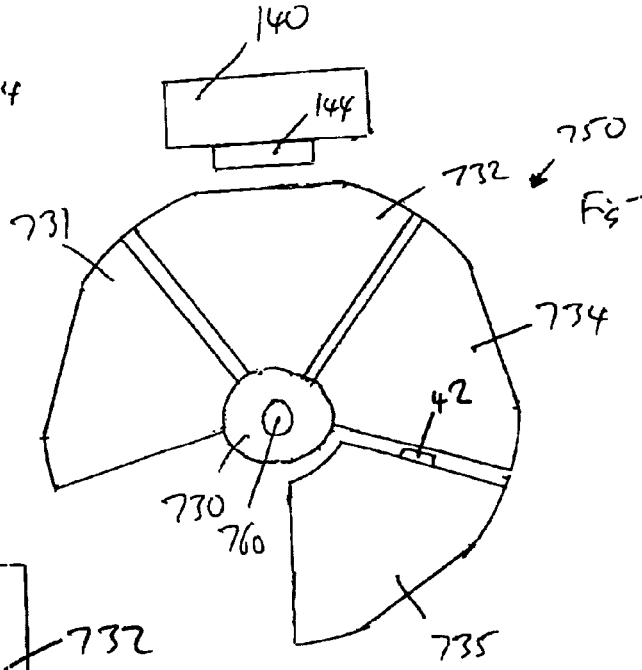
Figure 7C:
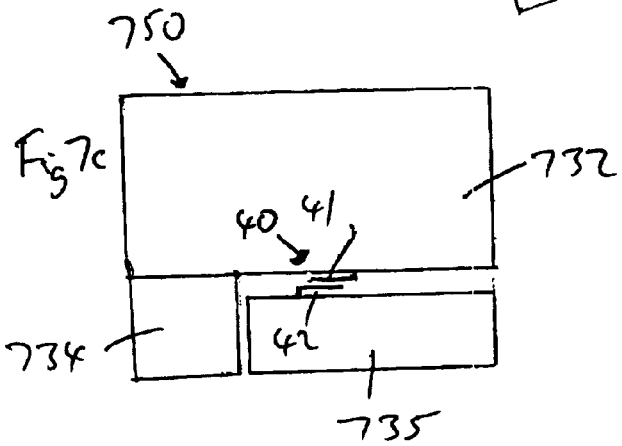

FIG. 7*a* is a schematic end view of a printhead service station in accordance with a third embodiment of the present invention with a service station carriage in a first rotary disposition;

FIG. 7*b* is a view of the arrangement of FIG. 7*a* with the service station carriage in a second rotary disposition;

FIG. 7*c* is a view in the direction of arrow B in FIG. 7*a*; and

Figure 8:
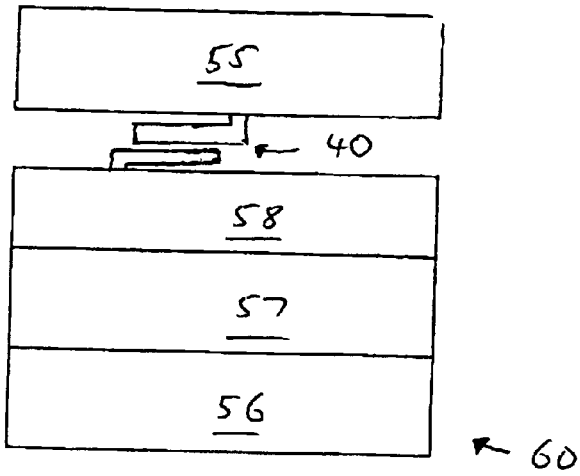

FIG. 8 is a schematic top plan view of a printhead service station in accordance with a fourth embodiment of the present invention.

Figure 1:
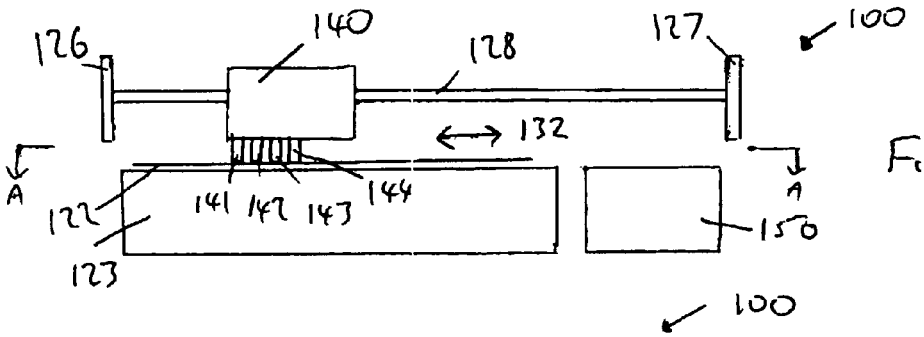
FIG. 1 is a schematic side view of a printer with a printhead carriage moving in a scanning direction.
Figure 2:
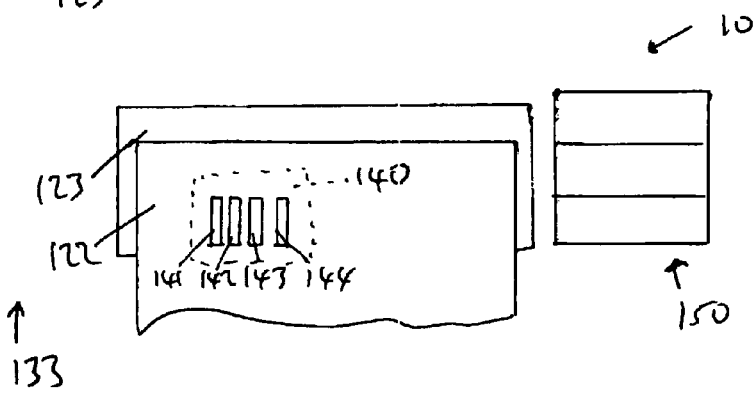
FIG. 2 is a sectional view on the line A—A of FIG. 1.

Referring to the drawings, FIGS. 1 and 2 show a schematic view of a printer 100 comprising a fixed platen 123. A print media 122 is arranged to be moved by a motor (not shown) over platen 123 in a print media advance direction indicated by arrow 133. The printer further comprises end plates 126,127 supporting a beam 128, along which a motor (not shown) causes a carriage 140 to move in reciprocating manner in a scanning or printing direction indicated by arrow 132. Printheads 141 to 144 are mounted on the carriage the printheads being arranged to print cyan, magenta, yellow and black ink respectively.

After each advance of the print media 122 in direction 133, the carriage undergoes one or more passes across the print media in direction 132 during which the printheads print ink on the print media.

At intervals of time, the carriage 140 is moved so as to locate printheads 141 to 144 over a service station 150 so that servicing operations can be performed on one or more of the printheads. The servicing operations will be described in greater detail below.

Figure 3:
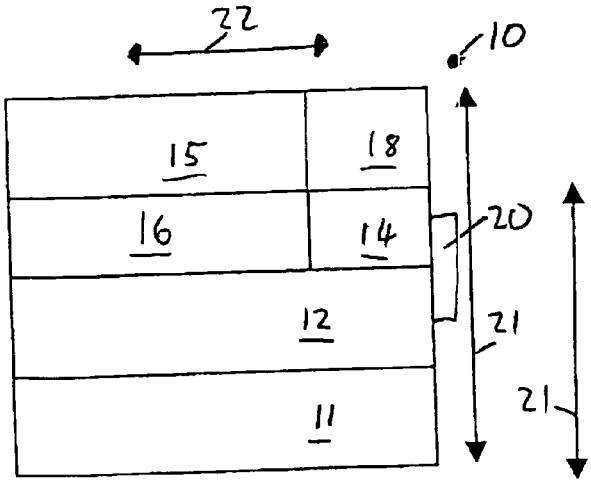
FIG. 3 is a schematic top plan view of a printhead service station of a prior art printer.

FIG. 3 shows, in accordance with the prior art, a printhead service station carriage 10 for a colour hardcopy device, in particular an ink-jet printer. The carriage comprises a servicing module 11 at the front of the carriage for capping the printhead pens, a servicing module 12 serving as a spittoon for the pens, a servicing module 14 for wiping a black pen and a servicing module 15 at the rear of the carriage for wiping the colour pens. The carriage is movable by a motor 20 in a reciprocating manner in the paper axis direction 21, which is perpendicular to the scan direction 22. In operation of a colour hardcopy device, it is required to wipe the black pen much more frequently than the colour pens. To wipe the black pen alone, module 14 is aligned with the scanning axis and a wiping operation is undertaken. To wipe the colour pens, module 15 is aligned with the scanning axis and a wiping operation is undertaken. It will be seen that regions 16 and 18 of the carriage constitute unused spaces.

Figure 4:
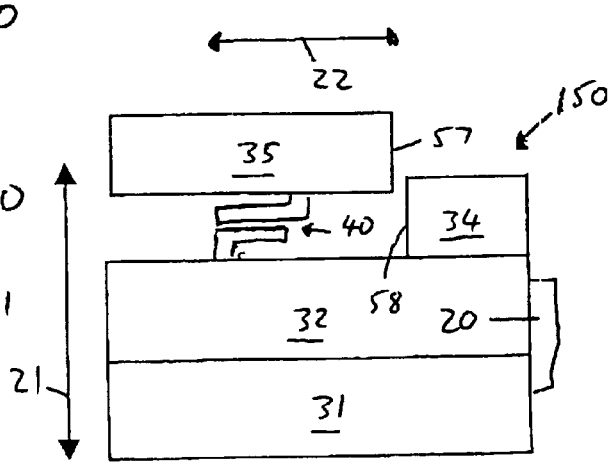
FIG. 4 is a schematic top plan view of a printhead service station in accordance with a first embodiment of the present invention.

Referring now to FIG. 4, a carriage 30 of a printhead service station 150 in accordance with a first embodiment of the present invention comprises a servicing module 31 at the front of the carriage for capping the pens, a servicing module 32 serving as a spittoon for the pens, and a servicing module 34 at the rear of the carriage for wiping the black pen. The carriage is driven by a motor 20 in a reciprocating manner in the direction 21. A servicing module 35 for wiping the colour pens is detachably connected to the carriage 30 by means of a connecting arrangement 40, shown in detail in FIG. 5. Module 35 is mounted on its own carriage, which travels on the same guidance system as main carriage 30.

In operation of the hardcopy device, when it is desired to wipe the black pen alone, module 35 is detached, motor 20 is driven to move module 34 into alignment with the scanning axis, and a wiping operation is undertaken. During this operation, module 35 is left stationary in its base position at the rear of the service station. When it is desired to wipe the colour pens as well, carriage 30 is moved adjacent module 35, module 35 is attached to the carriage, motor 20 is driven to move both modules into alignment with the scanning axis, and a wiping operation is undertaken. The carriage is then returned to its rear position and the module 35 is again detached to await the next colour pen wiping operation.

Figure 5:
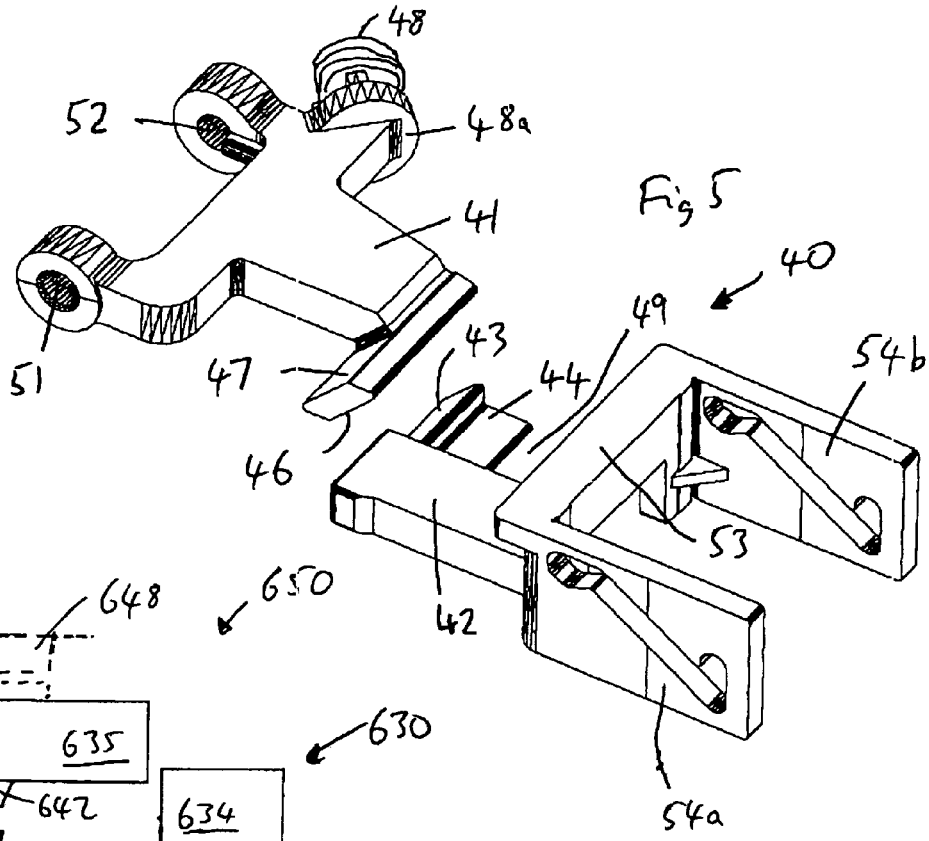
FIG. 5 is a perspective view of a releasable connection mechanism of the embodiment of FIG. 4.

FIG. 5 shows an enlarged view of the connecting arrangement 40, which comprises a first hook element 41, rotatably mounted at pivots 51, 52 on the top of servicing module 35, and a second hook element 42 fixed by a web portion 53 and brackets 54*a*, 54*b* to the top of carriage 30. Element 41 moves under the influence of a compression spring 48 which is urged against a spigot 48*a* of element 41.

As the motor 20 reciprocates carriage 30 in the direction of the paper axis 21, hook element 42 moves towards and away from hook element 41. When it is desired to attach module 35 to the carriage 30, the carriage is moved to the rear of the service station and inclined surface 43 of hook portion 44 of element 42 slides along inclined surface 46 of hook portion 47 of element 41. During this movement, element 41 is rotated upwardly and, when portion 44 has passed portion 47, downwardly so that portions 44 and 47 are then mutually engaged to allow module 35 to be moved to the scanning axis.

After an all-pens wiping operation has occurred, carriage 30 is again moved to the rear of the service station to return module 35 to its base position. Upon moving hook element 42 slightly further towards hook element 41 the latter falls into a gap 49 between hook portion 44 and web portion 53. The hook element 41 is thus rotated downwardly and allows hook element 41 to retract freely towards the front of the carriage. Until hook element 42 is again returned to connect to hook element 41, all the servicing operations take place without module 35 moving with the carriage 30.

The above-described arrangement has several advantages. Compared to the prior art device of FIG. 3 there is a saving of space in the print station carriage corresponding to the area of a servicing module, which in turn corresponds generally to the printhead area of the hardcopy apparatus. By mounting the elements 41, 42 at the top, only a small amount of extra space is necessary for connection arrangement 40 in direction 21, so that module 35 can be substantially aligned in use with module 34. Since the path in the service station for movement in the direction 21 of the carriage is twice the dimension of the carriage in this direction, there is a saving of twice the area of the servicing module in the area of "footprint" of the service station, and hence of the entire hardcopy apparatus.

A further advantage compared with the arrangement of FIG. 3 is that all the pens can be wiped in a single operation, rather than separate operations for modules 14 and 15.

Another advantage is that the weight of module 35 does not need to be carried around with carriage 30 when it is not needed. This reduces the weight and inertia of the components supported by carriage 30, thus permitting quicker operation of motor 20 and imposing less load on it. In addition this is achieved without requiring an extra motor for the servicing station. Yet when the less frequent service function is required it can be quickly and easily implemented.

Numerous modifications can be made to the above-described embodiments. For example the rotatable hook element 41 may be attached to the carriage 30 with hook element 42 being attached to the module 35.

In alternative space-saving arrangements the hook elements are both mounted underneath the module 35 and carriage 30 or are mounted on side surfaces 57, 58, FIG. 4. In further modifications, one or both of the hook elements is/are mounted in a respective recess.

Both hook elements may be rotatably mounted on the component which carries them.

Instead of having its own carriage running on a guidance system, the detachable servicing module may be supported, when not as its base station, by the service station carriage.

Instead of having its own motor 20, the service station carriage can be moved by a gear train connected to the main motor of the hardcopy device, i.e. the motor for moving the printhead carriage.

The connecting arrangement 40 can be constructed by any convenient detachable devices. If desired the hooks, or other connectors, may be selectively engaged and disengaged by a suitable electrical relay control device. The detachable module 35 may be attached magnetically to the service station carriage.

Figure 6:
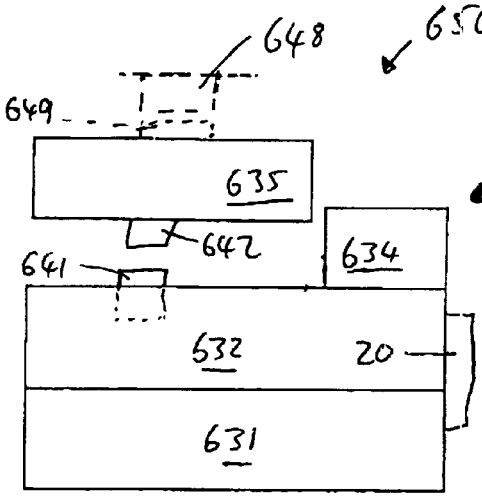
FIG. 6 is a schematic top plan view of a printhead service station in accordance with a second embodiment of the present invention.

FIG. 6 shows a carriage 630 of a printhead service station 650 in accordance with a second embodiment of the present invention comprising servicing modules 631,632,634 and 635 corresponding to modules 31,32,34 and 35 of the embodiment of FIG. 4. Instead of the connecting arrangement 40, carriage 630 is provided with an electromagnet 641 which is selectively switched on to attract and hold metallic part 642 of the detachable module 635. Module 635 then moves with the carriage 630. After module 635 has been aligned with the printheads and has treated the printheads it is returned to its base station and electromagnet 641 is switched off so that module 635 again becomes detached.

As with connection elements 41,42, the electromagnet 641 and/or the metallic part 642 may be mounted below or on the side of carriage 630 or module 635 respectively, or in recesses.

In another modification, the module 35 or 635 is attached to carriage 30 or 630 by a relatively weak connection, the effect of which can be selectively overcome by a relatively strong connection between the module 35 or 635 and a fixed part of the service station 150 or 650 to the rear of the module, i.e. on the side of the detachable module remote from the carriage. Thus in the case of magnetic connectors, for example, a relatively strong electromagnet 648 (shown in broken lines in FIG. 6) fixed rearwardly of module 635 may be selectively switched to attract a metallic part 649 to overcome the attraction between module 635 and carriage 630 caused by the relatively week electromagnet 641.

The service station carriage 30,630 can be arranged to be driven linearly in direction 21. Alternatively, the carriage 30,630 may be arranged to rotate about an axis parallel to the scanning axis, so that the scanning modules are arranged circumferentially.

FIG. 7*a* shows a carriage 730 of a printhead service station 750 in accordance with a third embodiment of the present invention. Carriage 730 is fixedly attached to a rotable by a spindle 760 extending parallel to the scanning axis of the printhead carriage 140. Fixedly attached to spindle 760 are service station modules 731,732 and 734 corresponding to modules 31,32 and 34 of the embodiment of FIG. 4. In FIG. 7*a* a pen capping module 731 is located underneath the printheads 141 to 144, only the black ink printhead 144 being visible in FIG. 7*a*.

In FIG. 7*b*, the carriage 730 has rotated to bring a spittoon module 732 underneath the printheads. A further rotation step of carriage 730 would bring a black pen wiping module 734 into the top position.

A detachable connection arrangement 40, such as that shown in FIG. 5, is provided between a colour pen wiping module 735 and carriage 730. Hook element 42 is fixed to module 735 and the other hook element 41 is fixed to module 732 which is itself fixed to the carriage 730.

In FIG. 7*b*, the arrangement 40 has not been connected so that, as the carriage 730 and the other modules move from the disposition shown in FIG. 7*c* to that shown in FIG. 7*b*, the detachable module 735 is left behind.

The servicing module which is optionally moved may have an alternative function. For example, FIG. 8 shows a fourth embodiment of the present invention in which it is a polyethyleneglycol (PEG) dispensing module 55 having its own carriage which is selectively attached to a main carriage 60. PEG is a liquid solvent which serves to clean a nozzle by dissolving dried ink which has produced a deposit within the nozzle. In addition PEG serves as a lubricant, in that it reduces the friction between the walls of the air bubbles formed in the ink nozzle and the interior surface of the nozzle itself, and thus removes the air bubbles to permit correct printing.

The embodiment of FIG. 8 comprises capping, spittoon and wiping modules 56, 57 and 58 and operates in a similar fashion to the first embodiment. Because the PEG dispensing operation is only seldom used, the time taken to attach and subsequently detach module 55 has a negligible effect on throughput. Instead of PEG, module 55 may dispense another cleaning and/or lubricating liquid such as glycerol.

The fourth embodiment may be modified so that module 55 performs a different relatively rarely-used function, for example scraping, snout wiping, priming or drop detection.

The hardcopy device may have only a single pen, e.g. black, or any number other than four. An exemplary combination is black, yellow, magenta, cyan, light cyan and light magenta. Colours may be duplicated, another exemplary combination being black, black, yellow, magenta and cyan.

The optionally-movable module may be located at the front of the service station instead of at the rear.

In a further modification, a service station may have two optionally-moved servicing modules. For example it may have one at the front and one at the rear. Alternatively, two such modules can be arranged at the rear, say, a first one being selectively attached to the main carriage 30 and the second one being selectively attached to the first one. By combining these modifications, a service station can have three or more optionally-moved modules.

Features and modifications of each of the described embodiments may be exchanged as desired.

What is claimed is:

1. A hardcopy device comprising at least one printhead mounted on a printhead carriage, said carriage being arranged to move in a printhead scanning direction along a scanning axis, a printhead service station arranged at an end of said printhead scanning axis and comprising a movable service station carriage having a plurality of servicing modules arranged to undertake servicing operations on said printhead, and a moving device, said moving device being arranged to move the service station carriage transversely of said scanning axis, wherein at least one of the servicing modules is connected by a detachable connection to at least one other servicing module.

2. A device according to claim 1, wherein the moving device is arranged to move said service station carriage in a straight line extending perpendicularly to said scanning axis.

3. A device according to claim 1, wherein the moving device is arranged to rotate said service station carriage around an axis extending parallel to said scanning axis.

4. A device according to claim 1, wherein said at least one service station carriage is mounted on a guidance system and said at least one other servicing module is mounted on a separate carriage mounted on the same guidance system.

5. A device according to claim 1, wherein said detachable connection comprises a first hook element rotatably connected to a first said servicing module and a second hook element fixedly attached to a second said servicing module.

6. A device according to claim 1 wherein said detachable connection is attached by means of a first movement of said service station carriage and is detached by a second movement of said service station carriage.

7. A device according to claim 1, wherein said at least one servicing module includes at least one of the group comprising a printhead capping module, a spittoon module and a black printhead wiping module.

8. A device according to claim 1 wherein said at least one other servicing module serves to wipe colour pens.

9. A device according to claim 1 wherein said at least one other servicing module serves to apply a cleaning and/or lubricating liquid.

10. A hardcopy device comprising one or more printheads and means for moving said printheads in a scanning direction along a scanning axis, and means for servicing said printheads, said servicing means including a first servicing means movable to a position for undertaking a first servicing operation and a second servicing means attachable to said first servicing means and movable to a position for undertaking a second servicing operation, wherein said servicing means is arranged to undertake said first servicing operation when said second servicing means is detached from said first servicing means and said servicing means is arranged to undertake said second servicing operation when said first servicing means and second servicing means are attached.

11. A service station for a hardcopy device, said service station being arranged to be mounted on said hardcopy device for relative movement thereto, and said service station comprising a plurality of servicing modules, at least one of the modules being detachably connected to the other servicing modules, wherein the service station is arranged to undertake a first servicing operation when at least one of the modules is detached and a second servicing operation when the modules are attached.

12. A method of servicing printheads of hardcopy devices comprising the steps of: moving the printheads into a servicing position, and, for at least a first servicing operation, bringing a first servicing module into alignment with the printheads to undertake the first servicing operation, and, for at least a second servicing operation, attaching said first servicing module to a second servicing module and moving it to a position in which at least the second servicing module is in alignment with the printheads to undertake the second servicing operation.

13. A method of servicing printheads of hardcopy devices comprising the steps of: moving the printheads in a printhead scanning direction into a servicing position, and, for at least a first servicing operation, moving a service station transversely of the scanning direction to bring a first servicing module into alignment with the printheads to undertake the first servicing operation, and, for at least a second servicing operation, moving the service station to a position in which it is attached to a second servicing module and then to a position in which at least the second servicing module is in alignment with the printheads to undertake the second servicing operation.

* * * * *